US007227103B2

(12) United States Patent
Esteras Duce et al.

(10) Patent No.: US 7,227,103 B2
(45) Date of Patent: Jun. 5, 2007

(54) INDUCTION HOT PLATE COMPRISING HEATING REGIONS HAVING A RECONFIGURABLE STRUCTURE, AND METHOD FOR INCREASING THE MAXIMUM POWER OF SAID HEATING REGIONS

(75) Inventors: Ignacio Esteras Duce, Zaragoza (ES); Fernando Monterde Aznar, Zaragoza (ES); Julio Rivera Pemán, Zaragoza (ES)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 11/007,027

(22) Filed: Dec. 8, 2004

(65) Prior Publication Data

US 2005/0109770 A1 May 26, 2005

(30) Foreign Application Priority Data

Aug. 1, 2002 (ES) ..... 200201902

(51) Int. Cl.
*H05B 3/68* (2006.01)

(52) U.S. Cl. ..... 219/443.1; 219/444.1; 219/447.1; 219/448.12; 219/633

(58) Field of Classification Search ..... 219/443.1, 219/444.1, 447.1, 448.12, 633
See application file for complete search history.

(56) References Cited

U.S. PATENT DOCUMENTS 6,462,316 B1 * 10/2002 Berkcan et al. ..... 219/502
6,492,627 B1 * 12/2002 Ensinger et al. ..... 219/518

FOREIGN PATENT DOCUMENTS

| | | | |
|---|---|---|---|
| DE | 8801237 | U1 | 5/1988 |
| DE | 4142872 | A1 | 6/1993 |
| DE | 19707159 | A1 | 8/1998 |
| EP | 0817531 | A2 | 1/1998 |
| EP | 0844807 | A1 | 5/1998 |

* cited by examiner

*Primary Examiner*—Shawntina Fuqua
(74) *Attorney, Agent, or Firm*—Russell W. Warnock; Craig J. Loest

(57) ABSTRACT

An induction hot plate including a plurality of heating regions with a reconfigurable structure. The hot plate includes at least two power modules, each supplying electrical power to at least one first and one second induction heating element. The maximum power to each of the regions can be increased by supplying electrical power from both power modules to only the first or the second induction heating element.

14 Claims, 1 Drawing Sheet

INDUCTION HOT PLATE COMPRISING HEATING REGIONS HAVING A RECONFIGURABLE STRUCTURE, AND METHOD FOR INCREASING THE MAXIMUM POWER OF SAID HEATING REGIONS

FIELD OF APPLICATION OF THE INVENTION

This patent application is a continuation of PCT/EP2003/07598, filed Jul. 14, 2003.

The present invention relates to an induction hot plate according to the preamble of the first claim.

PRIOR ART

The closest prior art to the invention is the European Patent Application EP 0844807 which belongs to the same proprietor as the present invention and which describes the best possible control of the power installed in induction hobs for domestic use having a topology with a re-configurable structure which allows two coils representing the heating elements to be supplied independently with power which can be regulated up to their rated values. In addition, it allows the total installed power to be utilised and used to supply each of the coils so that it allows ultrafast heating with a power capacity greater than the rated power of the coil without increasing the rating characteristics of the coil.

DESCRIPTION OF THE INVENTION

The object of the present invention is to provide an induction hot plate which comprises at least one heating region which is formed by two independent heating regions for which purpose each of said regions is assigned an induction heating element so that one or two of the regions can be activated depending on the size of the container to be heated and specifically such that the maximum heating power can be increased in order to shorten the heating time, such as for example to shorten the time taken to achieve a first boiling.

In order to achieve the afore-mentioned objects, the invention consists of a new induction hot plate of the type which comprises at least two power modules of which each supplies electrical power to at least one first induction heating element and a second induction heating element, each having a heating region for a cooking container associated with it, which power module interrupts a power supply to the second induction heating element to increase the maximum heating power of a first induction heating element.

The most important novelty of the invention is based on the feature that the heating regions of the first induction heating element of the two power modules together form a common heating region and that in addition, in order to increase the maximum heating power in the common heating region, the two power modules provide their respective total power to the first induction heating elements so that the heating time of the cooking container is considerably shortened.

In one embodiment of the invention the common heating region is realised as a heating region with two circuits with which are associated an outer annular heating region and an inner heating region which are each associated with one of the two first induction heating elements.

The invention provides for the incorporation of a device for identifying the container, such as a pot for example in order to determine the size of a base surface of a cooking container placed on the common heating region.

Depending on the size which is registered by the device for identifying the size of the base surface of the cooking container, the two power modules provide their total powers to the first induction heating elements of the common heating region only from a certain size of base surface.

If the registered size of the base surface of the cooking container is smaller than a certain size, only one of the two power modules provides its total power to the associated first induction heating element of the common heating region.

In addition, the invention provides to allow the maximum heating power of one of the second induction heating elements to be increased, for which purpose each of the power modules interrupts the power supply to the respective first induction heating element and provides its total power to the second induction heating element.

As already mentioned, the invention also relates to a method for increasing the maximum heating power of heating regions for cooking containers in an induction hot plate which has at least two power modules wherein from each of these modules electrical power is supplied at least to one first induction heating element and one second induction heating element, each having one of the heating regions associated with it, which power module interrupts a power supply to the second induction heating element and provides its total power to the first induction heating element to increase a maximum heating power of the first induction heating element and is characterised in that the heating regions of the first induction heating element of the two power modules together form a common heating region and that in order to increase the maximum heating power of the common heating region, the respective total power of the two power modules is supplied to the first induction heating elements.

For a better understanding of this patent description a single figure is appended which is an important component of the same and in which the object of the invention was shown in an explanatory and non-restrictive fashion.

DESCRIPTION OF THE PREFERRED EMBODIMENT

Figure 1:
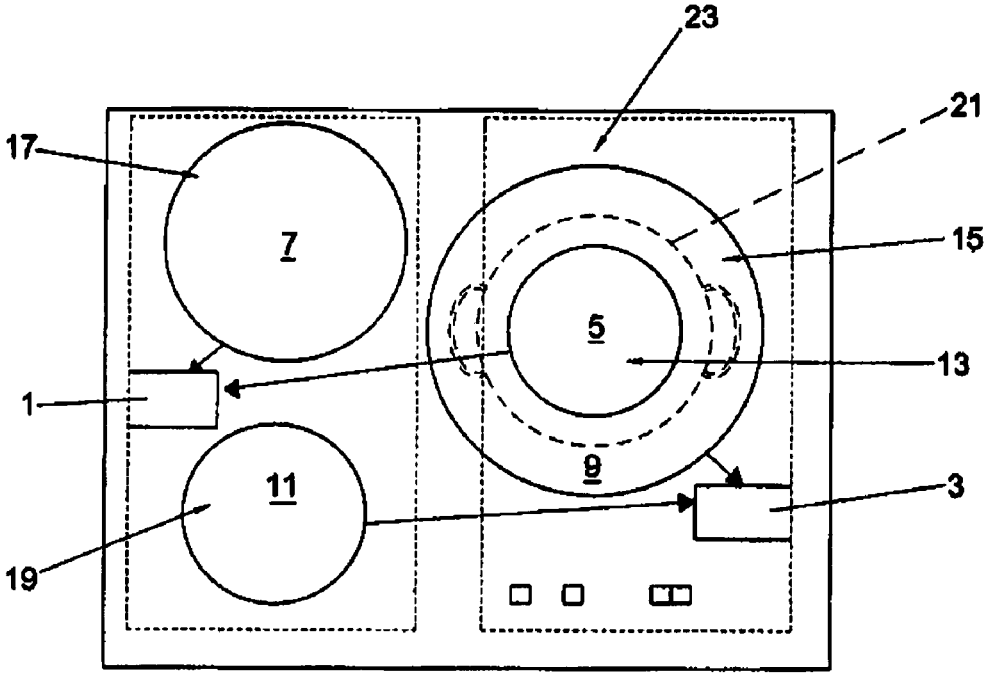
FIG. 1 shows a schematic view of a possible exemplary embodiment of a hot plate which is the subject matter of this invention.

The invention is described in the following on the basis of the previously discussed figure.

The hot plate of the exemplary embodiment of the invention comprises two power modules 1 and 3, of which each can supply electrical power to first induction heating elements 5 and 9 and second induction heating elements 7 and 11.

Associated with each of the induction heating elements is a heating region of a cooking container 21, such as a pot for example, so that the heating regions 13 or 15 are associated with the first heating elements 5 and 9 and the heating regions 17 or 19 are associated with the second heating elements 7 and 11.

As can be seen from the figure, the heating region 15 is an outer annular heating region and the heating region 13 is an inner circular heating region.

This configuration allows the heating of a cooking container 21 whose diameter is larger than that of the inner heating region 13 and smaller than that of the outer heating region 15.

If it is necessary to heat the cooking container 21 quickly, the total power provided by each of the two power modules 1 and 3 is provided to the first induction heating elements 5 and 9 so that the maximum power which is provided to them is increased and the heating time of the cooking container 21 is shortened considerably.

The invention comprises a device for identifying the size of the base surface of the cooking container 21 (not shown in the figures) which can be formed by a row of sensors so that the total powers of the power modules 1 and 2 can only be supplied to the common heating region 23 if the size of the base surface of the cooking container has a diameter larger than that of the inner circular heating region 13, as can be seen in the figure.

If the size of the base of the cooking container 21 has a diameter which is the same as or smaller than that of the inner heating region 13, only one of the two power modules 1 or 3 provides its total power to the induction heating element 5 of the common heating region 23 since in this case, as a result of the smaller size of the heating surface, its heating takes place more rapidly and it is not necessary to provide the power of both power modules 1 and 3.

There is also the possibility that it is desired to increase the maximum heating power of one of the second induction heating elements 7 or 11 in which case the power supply to the respective first induction heating element 5 or 9 is interrupted and its total power is provided to the second induction heating element 7 or 11.

What is claimed is:

1. An induction hot plate, comprising:

at least one first induction heating element having at least a first heating region for a cooking container;

at least one second induction heating element having at least a second heating region for a cooking container;

at least two power modules, each of which supplies electrical power to at least said first and said second induction heating element; and said two power modules both supplying electrical power to only one of said first and said second induction heating elements to temporarily increase the electrical power to a maximum to said one induction heating element.

2. The induction hot plate according to claim 1, including said first induction heating element including a pair of induction heating elements forming a pair of heating regions which together form a common heating region and said two power modules both supplying electrical power to said first induction heating element by supplying electrical power to said pair of induction heating elements to temporarily increase the electrical power to a maximum to said first induction heating element.

3. The induction hot plate according to claim 2, including said common heating region is constructed as a two-circuit heating region with an outer concentric heating region and an inner concentric heating region, each associated with one of said pair of induction heating elements.

4. The induction hot plate according to claim 2, including a pot recognition device which registers the size of a base surface of a cooking container placed on said common heating region.

5. The induction hot plate according to claim 4, including said two power modules both supplying electrical power to said pair of induction heating elements only when said cooking container base surface exceeds a predetermined size.

6. The induction hot plate according to claim 5, including only one of said two power modules supplying electrical power to said pair of induction heating elements when said cooking container base surface is less than said predetermined size.

7. The induction hot plate according to claim 1, including said second induction heating element including a pair of separate induction heating elements forming a separate pair of heating regions and said two power modules both supplying electrical power to one of said separate induction heating elements to temporarily increase the electrical power to a maximum to said separate induction heating element.

8. A method for increasing the maximum heating power for one heating region of an induction hot plate including at least two separate heating regions, the two separate heating regions formed by at least one first induction heating element having at least a first heating region for a cooking container and at least one second induction heating element having at least a second heating region for a cooking container at least two power modules, each of which supplies electrical power to at least said first and said second induction heating element, comprising:

supplying electrical power to only one of said first and said second induction heating elements from both of said two power modules to temporarily increase the electrical power to a maximum heating power to said one induction heating element.

9. The method according to claim 8, including said first induction heating element including a pair of induction heating elements forming a pair of heating regions which together form a common heating region and supplying electrical power to said first induction heating element by supplying electrical power from both of said two power modules to said pair of induction heating elements to temporarily increase the electrical power to a maximum to said first induction heating element.

10. The method according to claim 9, including constructing said common heating region as a two-circuit heating region with an outer concentric heating region and an inner concentric heating region, each associated with one of said pair of induction heating elements.

11. The method according to claim 9, including measuring the size of a base surface of a cooking container placed on said common heating region.

12. The method according to claim 11, including supplying electrical power from both of said two power modules to said pair of induction heating elements only when said cooking container base surface exceeds a predetermined size.

13. The method according to claim 11, including supplying electrical power from only one of said two power modules to said pair of induction heating elements when said cooking container base surface is less than said predetermined size.

14. The method according to claim 8, including forming said second induction heating element from a pair of separate induction heating elements, each forming a separate pair of heating regions and supplying electrical power from both of said two power modules to one of said separate induction heating elements to temporarily increase the electrical power to a maximum to said separate induction heating element.

* * * * *

UNITED STATES PATENT AND TRADEMARK OFFICE

CERTIFICATE OF CORRECTION

PATENT NO. : 7,227,103 B2
APPLICATION NO. : 11/007027
DATED : June 5, 2007
INVENTOR(S) : Esteras Duce et al.

It is certified that error appears in the above-identified patent and that said Letters Patent is hereby corrected as shown below:

On the title page insert the following:

Related U.S. Application Data

(63) Continuation of application No. PCT/EP2003/007598, filed on July 14, 2003.

Signed and Sealed this

Thirty-first Day of July, 2007

JON W. DUDAS
*Director of the United States Patent and Trademark Office*